US009343002B2

(12) United States Patent
Hagemann et al.

(10) Patent No.: US 9,343,002 B2
(45) Date of Patent: May 17, 2016

(54) WINDOW INCLUDING INTEGRATED DISPLAY SIGNAGE

(75) Inventors: Lawrence A. Hagemann, Raleigh, NC (US); David L. Turney, Dallas, TX (US)

(73) Assignee: LUMINATOR HOLDING L.P., Plano, TX (US)

( * ) Notice: Subject to any disclaimer, the term of this patent is extended or adjusted under 35 U.S.C. 154(b) by 0 days.

(21) Appl. No.: 13/586,716

(22) Filed: Aug. 15, 2012

(65) Prior Publication Data

US 2013/0074383 A1 Mar. 28, 2013

Related U.S. Application Data

(60) Provisional application No. 61/525,409, filed on Aug. 19, 2011.

(51) Int. Cl.

| | |
|---|---|
| ***G09F 13/04*** | (2006.01) |
| ***G09F 13/00*** | (2006.01) |
| ***G09F 9/33*** | (2006.01) |
| ***G09F 21/04*** | (2006.01) |

(52) U.S. Cl.

CPC ..... *G09F 13/005* (2013.01); *G09F 9/33* (2013.01); *G09F 13/0404* (2013.01); *G09F 21/048* (2013.01)

(58) Field of Classification Search

CPC ..... G09F 21/04; B60R 1/1207; B60Q 1/2665
USPC ..... 359/630; 362/494, 503, 235–237, 362/311.02, 613, 616; 40/590, 591, 452
See application file for complete search history.

(56) References Cited

U.S. PATENT DOCUMENTS

| | | | | |
|---|---|---|---|---|
| 6,520,666 | B1 * | 2/2003 | Beyerlein et al. | 362/471 |
| 7,048,422 | B1 * | 5/2006 | Solomon | 362/503 |
| 7,095,318 | B1 * | 8/2006 | Bekhor | 340/485 |
| 7,477,140 | B1 * | 1/2009 | Booth et al. | 340/471 |
| 7,604,377 | B2 * | 10/2009 | Yu et al. | 362/249.04 |
| 2007/0217213 | A1 * | 9/2007 | Chang | 362/503 |
| 2011/0146119 | A1 * | 6/2011 | Wagner | 40/452 |

OTHER PUBLICATIONS

Patent Cooperation Treaty; International Preliminary Report on Patentability for PCT/US12/51170 (related application); Jul. 31, 2013; Cassandra Davis; 5 pages.

* cited by examiner

*Primary Examiner* — Cassandra Davis
(74) *Attorney, Agent, or Firm* — Howison & Arnott, LLP

(57) ABSTRACT

A display apparatus comprises a transparent panel and a display system for displaying information through a light emitting array that is enclosed within the transparent panel.

19 Claims, 4 Drawing Sheets

WINDOW INCLUDING INTEGRATED DISPLAY SIGNAGE

CROSS-REFERENCE TO RELATED APPLICATIONS

This application claims benefit of U.S. Provisional Application No. 61/525,409, filed Aug. 19, 2011, entitled WINDOW INCLUDING BUILT-IN DISPLAY SIGNAGE, the specification of which is incorporated herein in its entirety.

TECHNICAL FIELD

The present invention relates to display signage for use in windows of vehicles such as busses, trains, etc., and more particularly, to display signage that is integrated within a window.

BACKGROUND

Presently, within buses, trains and other public transportation vehicles, electronic signage provides information to individuals outside of the public transportation vehicle with respect to the destination, route, etc. relating to the vehicle. Normally, this is accomplished by placing sign systems behind the front windshield or windscreen or behind a side window of the vehicle. The windshield, windscreen or window normally comprises a large piece of glass that is custom fitted within the window space of the public transportation vehicle. The sign system will normally be located on the front of the vehicle or on a side window normally right behind the door for entering into the public transportation vehicle. This provides riders with information who are getting on the public transportation vehicle of the particular destination or route number associated with the vehicle. This type of placement when on a side window of a public transportation vehicle can be intrusive to passengers who are sitting in the seat next to this window.

A major problem arising from the placement of window signage systems upon the front or side of the vehicle comes from the need to periodically clean the inside of the windscreen or window that is between the signage system and the inner face of the window. After extended periods of use, brake dust or other types of dirt may build up between the window and the signage system. In order to clean the window, the signage system must be removed either completely or partially in order to provide access to the glass between the signage system and the inside face of the window for cleaning. This can require a great deal of maintenance time and effort by employees of the public transportation system. Thus, there is a need for some type of sign system that still provide relevant information to the passengers and users of the system but overcomes some of the problem discussed hereinabove with respect to the space required by the signage systems and the periodic maintenance and cleaning requirements associated with them.

SUMMARY

The present invention, as disclosed and described herein, in one aspect thereof, comprises a display apparatus including a transparent panel. A display system for displaying information through a light emitting array is enclosed within the transparent panel.

BRIEF DESCRIPTION OF THE DRAWINGS

For a more complete understanding, reference is now made to the following description taken in conjunction with the accompanying Drawings in which.

DETAILED DESCRIPTION

Figure 1:
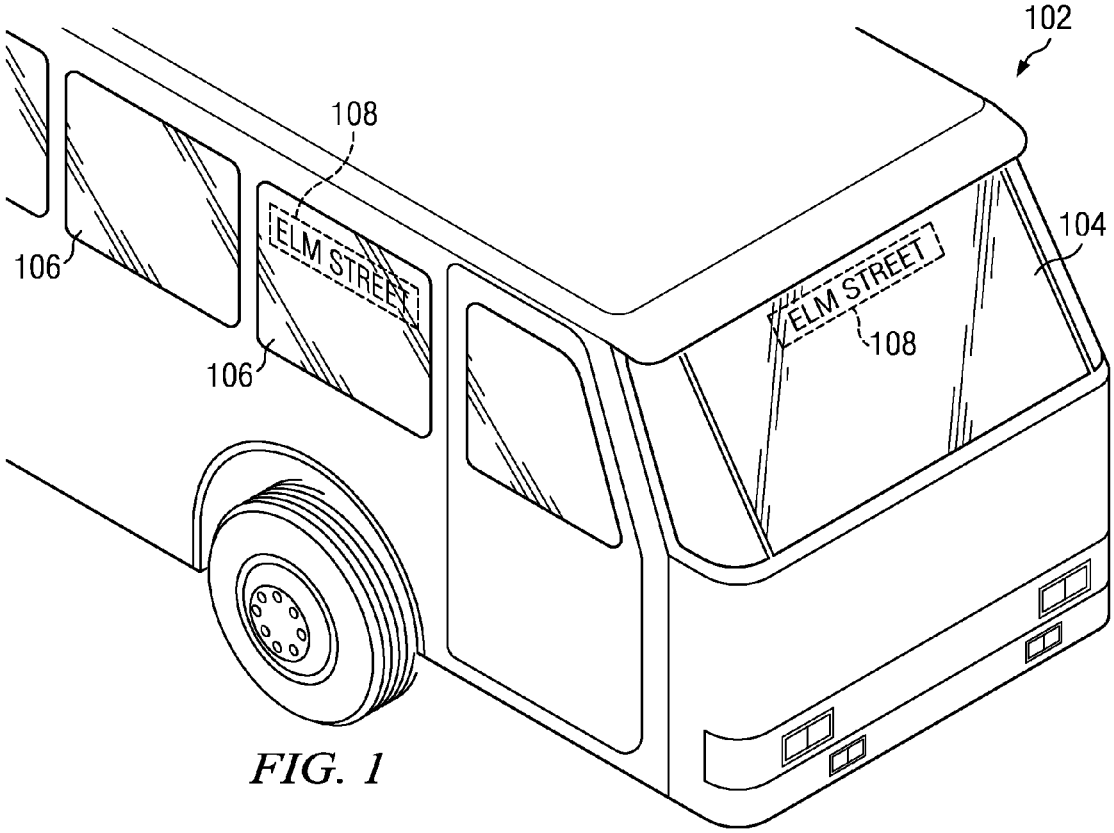
FIG. 1 illustrates integrated signage located within a windshield and a side window of a public transportation vehicle.

Referring now to the drawings, wherein like reference numbers are used herein to designate like elements throughout, the various views and embodiments of a window including integrated display signage are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring now to the drawings, and more particularly to FIG. 1, there is illustrated a public transportation vehicle which in this case comprises a bus. However, it would be realized by one skilled in the art that various types of public transportation vehicles such as trains, subways, monorails, people movers, etc. would find application of the described integrated display systems equally applicable, or alternatively, such integrated display system would be useful in any type of vehicle including a window that is required to present some type of information external to the vehicle for informational, advertising or other types of purposes.

The public transportation vehicle 102 includes a front windshield 104 and a number of side windows 106. Within the front windshield 104 is included a integrated display system 108 through which various types of passenger related informational or advertising information may be displayed to individuals external to the public transportation vehicle 104. In a present example, the integrated display system 108 displays the information "Elm Street" to illustrate the destination for the public transportation vehicle 102. Additionally, on the side window 106, the integrated display system 108 is included in a top portion of the side window 106. Again, the integrated display system 108 within the side window 106 provide destination information in the form of the name "Elm Street" providing an indication of the route or destination of the public transportation vehicle 102. The integrated display system 108 rather than being located behind the windshield 104 or the side windows 106, as implemented within previous configurations, is located within the glass of the windshield 104 or within the glass of the side window 106 between layers of glass or Plexiglass® as will be more fully described hereinbelow. In this manner, the windshield 104 or side window 106 may be shaped to fit within any desired bus or public transportation vehicle configuration, and the shape of the integrated sign systems 108 can be conformed to the lines of the front windshield 104 or side windows 106 of the public transportation vehicle 102 to be easily implemented within any type of vehicle or configuration.

Figure 2:
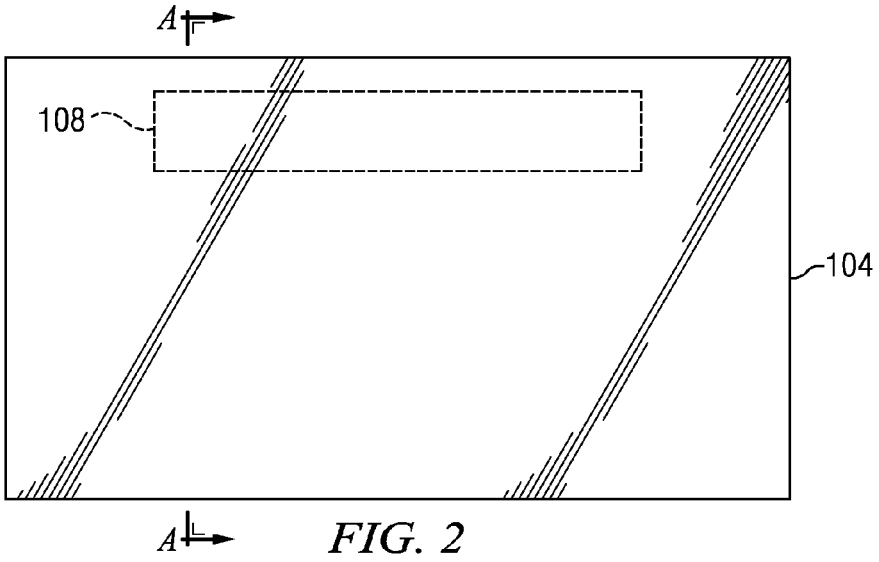
FIG. 2 is a front view of a window including integrated signage.

Referring now to FIG. 2, there is illustrated a frontal view of a windshield 104 including an integrated display system

108. The windshield 104 comprises a substantially rectangular shape that is configured to fit within the front windshield opening of an associated public transportation vehicle 102. The windshield 104 may comprise a flat or curved piece of glass or Plexiglass® product for use on the front or side window of a public transportation vehicle that is installable within the openings of the public transportation vehicle as normal windows and windshields are. Integrated between the layers of the windshield 104 is the integrated display system 108 illustrated generally by the dash line within FIG. 2. The integrated display system 108 is used for displaying various types of textual and numeric information to passenger viewing the windshield 104.

The components comprising the integrated display system 108 are substantially transparent when possible to enable the view of an individual or driver located behind a window or windshield to be substantially unimpeded. This is a significant advantage to the system in that a passenger or driver may look through the window without having their vision impaired. Presently existing signage that is located within the public transportation vehicle may often block the rider's view to the outside world because of the bulky case associated with this signage. For passengers who may be standing and holding on to overhead bars or straps, they are required to jockey for position in order to be able to look around the existing signage casings in order to see where the bus is located along a route. By utilizing an integrated signage configuration as described herein, the mostly transparent sign system provides a much less intrusive manner for displaying the external information while limiting the manner in which the view of the passengers on the bus is impaired.

Additionally, by utilizing an integrated signage system the need for mechanical support members or brackets within the public transportation vehicle 102 is removed since the signage is supported internally within the window or windshield. This will enable a reduction in the overall weight of the signage system, by upwards of 40 pounds which translates into decreased consumption of fuel within the public transportation vehicle since weight considerations affect the gas mileage of the vehicle.

Additionally, by utilizing an integrated signage system of FIG. 2, no moving parts or cables are used within the integrated display system 108 that may break due to a vibration of the public transportation vehicle when the vehicle is in operation. Additionally, the display system elements are not subjected to the intrusion of dirt or other contaminated particles which may degrade the operation and function of the elements of the sign. The integration of the signage system with the window make cleaning and operation of the system more efficient. The integrated signage system 108 would not be repairable in a traditional sense since the components are integrated within the window, but the window would, in most cases need to be replaced as a whole when components within the integrated signage system 108 wear out or degrade in performance Referring now to FIG. 3, there is illustrated a side view of the window including an integrated signage system 108 along line AA of FIG. 2. As can be seen, the integrated display system 108 is sandwiched between two pieces of transparent material 302. The transparent layers 302 may comprise glass or Plexiglass® that comprises the bulk of the windshield. The transparent layer 302 enables the window to be easily seen through by drivers and passengers. The integrated display system 108 comprises all of the electrical and display components necessary for electronically displaying information relating to the route or destination information of the public transportation vehicle 102.

Figure 3:
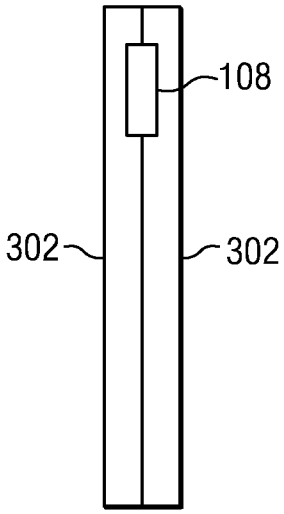
FIG. 3 is a side view of the integrated signage layer.
Figure 4:
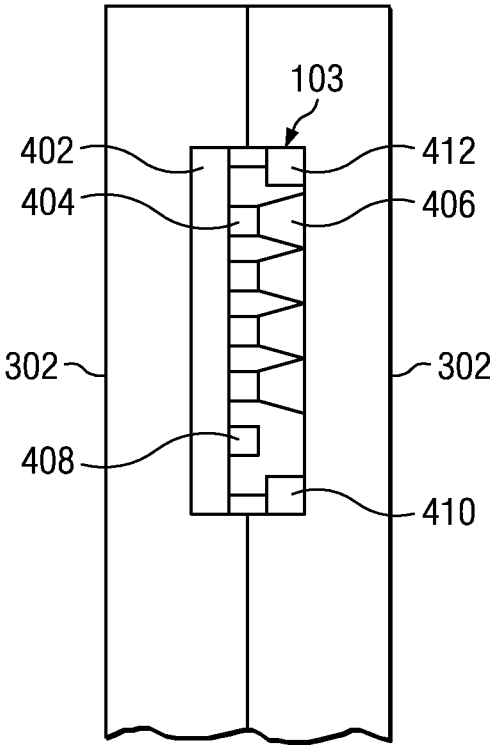
FIG. 4 is a side view more particularly illustrating the components of the integrated signage system with respect to an LED system.

Referring now to FIG. 4, there is provided a more detailed illustration of the integrated signage system 108 located within the transparent layer 302 as illustrated with respect to FIG. 3. Within the integrated signage system 103, a transparent support layer 402 is used for mounting the various components of the system and providing electrical interconnection therebetween. The transparent support layer 402 is either made of a flexible material enabling it to conform to the shape of the window or is molded to fit the shape of the window. Connected to the transparent support layer 402 are a number of integrated display elements 404 that are used for providing a display array between the transparent layers 302. The integrated display elements 404 may comprise LEDs or other forms of single point or pixel-like light radiators, in one embodiment, to form an X×Y array for displaying information. In other embodiments, which will be more fully described hereinbelow, the integrated display elements 404 may comprise other types of light emitting sources such as organic LEDs (OLEDs) as an illumination source.

The X×Y array of integrated display elements 404 comprise different size display matrixes depending upon the particular use within a public transportation vehicle. For example, within the front windshield of a bus or train, the array would normally comprise a 19×160 element array for displaying information at the top of the windshield. Within a side window, the array would normally comprise 16×108 element array. While arrays of this size would be beneficial within front and side windows of a public transportation vehicle, it will be realized that an array of any size may be utilized depending on the particular application desire and/or the size of the window in which the integrated window display 108 is being implemented.

When the integrated display elements 404 comprise a single light point emitting device such as an LED, a masking hood 406 may be utilized to shield the LED from external light interference. The masking hood 406 comprises a black masking element to surround the integrated display element 402 to mask or minimize the effects of intruding sun light that would adversely affect the display of light emitted from the integrated display element 404. The masking hood 406 would act like a shade or awning with respect to the integrated display element 404. The masking hood 406 may additionally be utilized to conduct heat away from the individual integrated display elements 404 within the integrated sign system 108. In addition to the light shading protection provided by the masking hood 406, the glass or plastic transparent layers 302 may include a lamination or coating having a light repelling material that would be used to keep sun light from impending on individual integrated display elements 404, and thus, improve the overall contrast between the "on" and "off" conditions of the integrated display system 108.

The integrated display elements 404 are controlled by other integrated circuit elements 408 that are mounted on the transparent substrate 402. The integrated circuits 408 provides control functionality enabling the display of desired words and elements in a particular manner as will be more fully described hereinbelow. The integrated circuit elements 408 are interconnected with the integrated display elements 404 using a transparent conductive film material for signal and/or power distribution between the integrated display elements 404 and the integrated circuit elements 408 within the integrated signage system 108 would be provided through a ground conduit 410 and power conduit 412. The ground conduit 410 provides a system power return to ground for the integrated display system 108. The power conduit 412 would normally provide a 3.3 volt DC voltage source. The power conduit 412 and ground conduit 410 may be located on the outer edges of the integrated signage display system 108 along the top/bottom or left/right hand edges of the display system 108.

The entire assembly comprising the transparent layers 302 and the integrated display signage system 108 are glued or bonded together using some type of transparent bonding material that may tack the components together at selected locations. One example of this bonding material would comprise some type of double sided adhesive to be strategically located throughout the window to bond the glass pieces together and encase the integrated display system 108 therebetween.

Figure 5:
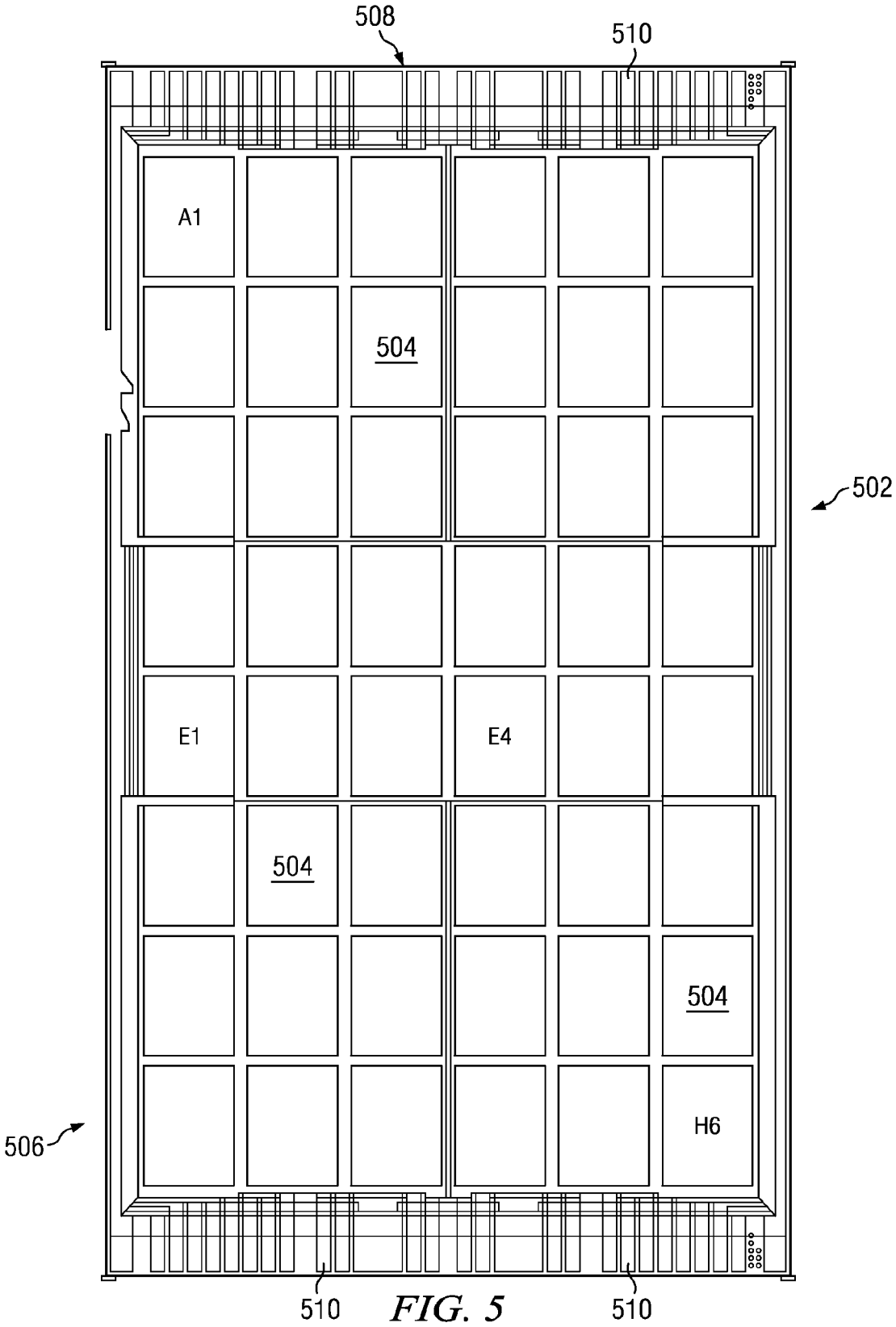
FIG. 5 illustrates an example of an OLED (organic LED) device for use within an integrated signage system.

Referring now to FIG. 5, there is illustrated an alternative embodiment of the integrated display elements 402 wherein rather than utilizing an LED, an organic LED (OLED) array 502 is used. An OLED array offers a uniform light generating surface rather than a specific light point as found within traditional LEDs. Thus, the integrated display element 404 would comprise an array of light generating surfaces 504 rather than a specific light point as provided by traditional LEDs. A significant benefit of an OLED display over a traditional LED or liquid crystal display is that OLEDs do not require a backlight to function. Thus, an OLED display would draw far less power enabling longer operation times in battery operated systems. Additionally, because an OLED device does not require a backlit display, OLED displays can be much thinner than an LCD panel. This would of course provide a great benefit within a signage integrated within a window. An organic light emitting diode (OLED) is also referred to as a light emitting polymer (LEP) and an organic electroluminescent (OEL). An organic light emitting diode is a light emitting diode using an electro luminescent layer that is composed of a film or an organic compound. The layer usually contains a polymer substance that enables suitable organic materials to be deposited thereon. The materials are deposited in row 504 and columns 508 onto a flat carrier using a simple printing process. The resulting matrix can emit light of different colors. An example of an OLED device is illustrated in FIG. 5. Various connectors at pads 510 on each side of the OLED provides for electrical connections to the display elements 504.

Figure 6:
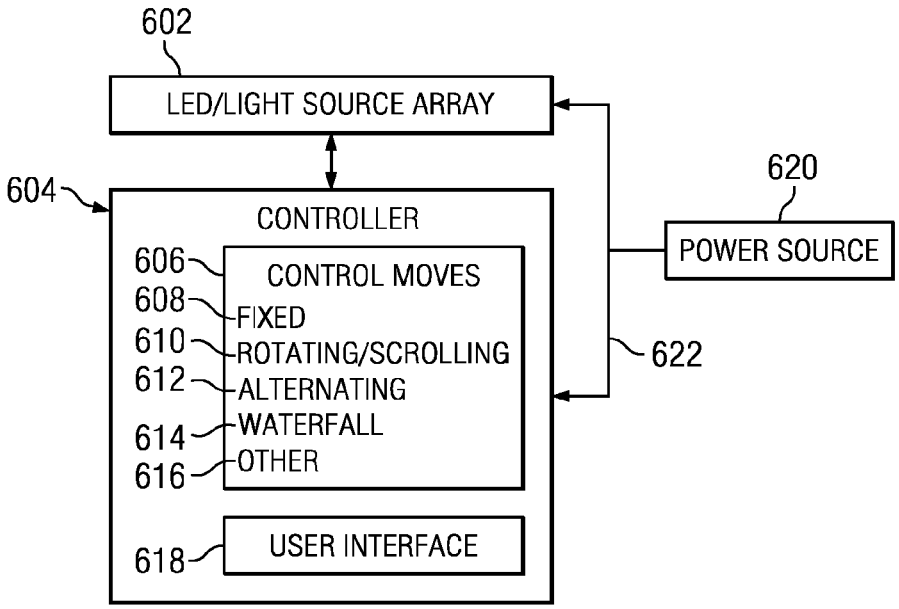
FIG. 6 is a block diagram illustrating the various electrical components of an integrated signage system.

Referring now to FIG. 6, there is provided a block diagram of the integrated sign system 108. The LED/light storage array 602 comprises the array of light emitting devices such as an LED array or OLED array that have been discussed previously with respect to FIGS. 4 and 5. The LED/light source array 602 is responsible for presenting the alpha numeric information to individuals outside of the public transportation device.

The LED/light source array is controlled by the controller logic 604. The controller logic 604 controls the information that is displayed by the LED light source array 602 and additionally controls the manner in which the information is displayed by the LED/light source array. The control logic 604 provides a variety of control modes 606 that enable the LED/light source array 602 to present information to external viewers in a variety of mode formats. In a fixed mode 608, the LED/light source array 602 continuously displays selected alpha numeric information in a non-moving and steady state fashion. This causes the LED/light source array 602 to present the information as a non-changing sign. The rotating/scrolling mode 610 enables information to be displayed by the LED/light source array 602 that scrolls across the display area from left to right or right to left in a continuous, horizontal fashion. The rotating/scrolling mode 610 enables long strings of alpha numeric text to be presented providing more information than would normally be possible on a single information screen. The alternating mode 612 of operation causes the LED/light source array 602 to display information in an alternating fashion. For example, the LED/light source array 602 could first display the name of the route the public transportation vehicle is associated within a first display and next display the destination of the vehicle in a second display in an alternating fashion. The waterfall mode 614 controls the LED/light source array 602 to display the sign information in a rotating fashion from top to bottom or bottom to top. This would be similar to the rotating/scrolling mode except the information moves along the Y axis of this sign rather than the X axis with respect to the rotating/scrolling mode 610.

One skilled in the art would understand that other types of display modes 616 may also be provided by the controller logic 604 to control operation of the LED/light source array 602 in a variety of other conceivable fashions. In addition to operating in the above-described modes of operation, the controller logic 604 may select, or the device may be preprogrammed, to control the LED/light source array 602 in either a direct drive or multiplexing mode of operation. Within the direct drive configuration, each of the display elements are individually driven by the control logic 604. In the multiplexing mode of operation, multiple devices may be controlled from a limited number of driver locations using multiplexing techniques.

The control logic 604 also includes a user interface 618 to enable selection and programming of the various modes of operation. The user interface may provide a direct keyboard/mouse interface which plugs directly into to the controller 604 or comprise a permenate part of the system enabling an operator to program the information to be displayed by the LED light source array 602. Alternatively, the user interface 618 could comprise a wireless interface for receiving wireless signals from a remotely located source in order to control the operation of the LED/light source array 602 from a central management location. Each of the LED light source array 602 and controller logic 604 are powered by a power source 620 that provides electrical power to each of the devices over the public transportation vehicle's power net 622.

Figure 7:
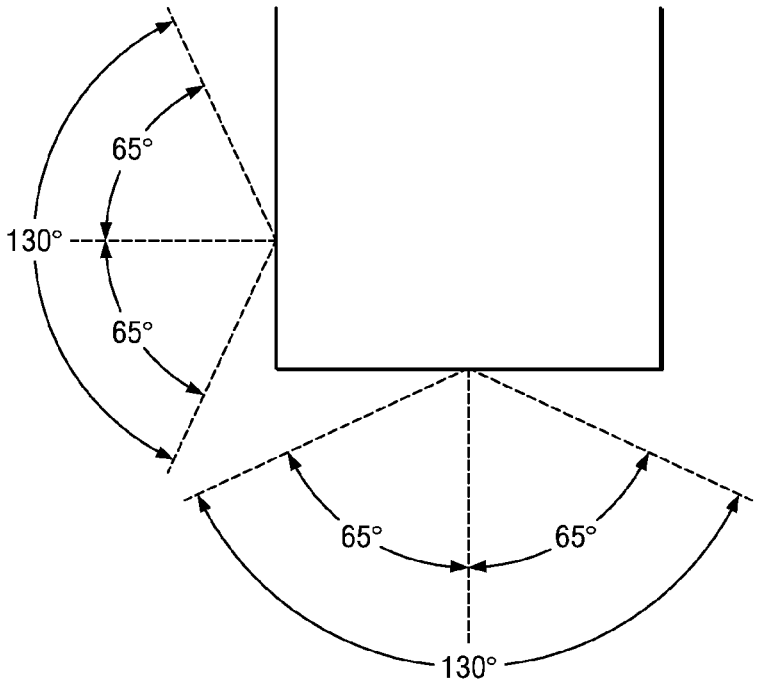
FIG. 7 illustrates the viewing angles of the sign at the front and side of the public transportation vehicle.

Referring now to FIG. 7, there is illustrated the associated viewing angles associated with a sign on a front windshield of a public transportation vehicle or a side window of a public transportation vehicle. In a preferred embodiment, the integrated sign system provides a display angle of approximately 130° with respect to each of the display elements within the display array. This provides 65° of viewing angle to each side of the central line of viewing of the sign. These viewing angles are applicable to both a front windshield display or a side window display of a public transportation vehicle.

An integrated display system such as that described hereinabove would provide a number of benefits and advantages over existing non-integrated display systems that are presently utilized within the public transportation industry. As discussed, the integration of the signs within the windows protect the display arrays from external environmental conditions such as dirt, brake dust, water, etc. that may adversely affect the operation of the display system. The operating circuitry would be protected and encased within the transparent panel of the windshield or window providing a large degree of protection. Replacement of the displays would merely involve the replacement of the entire window without requiring the movement of a separate display component in addition thereto. The lack of moving parts or cables associated with the integrated display system limits the maintenance issues caused by breaking of cables or moving parts due to the vibration of the vehicle when in operation. Thus, overall maintenance and installation of display with respect to the integrated system would be greatly improved over those associated with presently existing display systems.

It will be appreciated by those skilled in the art having the benefit of this disclosure that this window including integrated display display provides a an improved manner for displaying information without blocking rider views and improving system maintenance issues. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A display apparatus comprising:

a transparent panel, wherein the transparent panel includes a first portion and a second portion such that the first portion comprises a first cavity portion and the second portion comprises a second cavity portion that together define a single cavity within the interior of the transparent panel; and a display system for displaying alphanumeric information, the display system comprising:

a light emitting array of display elements enclosed in the single cavity within the interior of the transparent panel;

a fundamentally transparent molded substrate configured to support the light emitting array display elements, configured to provide electrical interconnection between the display elements, and positioned in the single cavity such that a back side of the fundamentally transparent molded substrate abuts an inside surface and inside side wall of the first cavity portion; about each display element, masking hood features extend from a front surface of the fundamentally transparent molded substrate to an inner surface of the second portion such that the fundamentally transparent molded substrate is held within the single cavity.

2. The display apparatus of claim 1, wherein the display system is configured to display alphanumeric characters in response, to at least one control signal; and wherein the display apparatus further comprises a controller for generating the at least one control signal.

3. The display apparatus of claim 2, wherein the controller controls the display system to provide a plurality of control modes to alter a manner for displaying the alphanumeric characters on the light emitting array.

4. The display apparatus of claim 3, wherein the display apparatus further comprises a user interface enabling selection of one of the plurality of control modes and selection of the alphanumeric characters for display.

5. The display apparatus of claim 1, wherein the display elements of the light emitting array comprise light emitting diodes.

6. The display apparatus of claim 1, wherein the display elements of the light emitting array comprise organic light emitting diodes.

7. The display apparatus of claim 1, wherein the the masking hood features are configured to limit the effects of intruding sunlight by operating as a miniature shade or awning with respect to each one of the display elements.

8. A display apparatus, comprising:

a transparent panel, wherein the transparent panel includes a first portion and a second portion such that the first portion comprises a first cavity portion and the second portion comprises a second cavity portion that together define a single cavity within the interior of the transparent panel;

a display system for displaying information, the display system being enclosed in the single cavity within the interior of the transparent panel, wherein the display system further comprises:

an array of light emitting diodes for displaying alphanumeric characters, the array of light emitting diodes being responsive to at least one control signal;

a controller configured to generate the at least one control signal; and a fundamentally transparent molded substrate configured to support each of light emitting diode in the array of light emitting diodes, configured to provide electrical interconnection between the light emitting diodes, and positioned in the single cavity such that a back side of the fundamentally transparent molded substrate abuts an inside surface and inside sidewall of the first cavity portion; about each light emitting diode, masking hood features extend from a front surface of the fundamentally transparent molded substrate to an inner surface of the second portion such that the fundamentally transparent molded substrate is held within the single cavity.

9. The display apparatus of claim 8, wherein the controller is positioned in a predetermined location in the fundamentally transparent molded substrate and electrically connected to control the array of light emitting diodes in order to provide a plurality of control modes that alter a manner for displaying the alphanumeric characters on the array of light emitting diodes.

10. The display apparatus of claim 9, wherein the display system further comprises a user interface enabling selection of one of the plurality of control modes and enabling selection of the alphanumeric characters for display on the array of light emitting diodes.

11. The display apparatus of claim 9, wherein the plurality of control modes include at least two of a fixed mode for displaying the alphanumeric characters in a fixed position, a rotating mode for scrolling the alphanumeric characters in a horizontal direction, a waterfall mode for scrolling the alphanumeric characters in a vertical direction and an alternating mode for switching between a first display of alphanumeric characters and a second display of alphanumeric characters.

12. The display apparatus of claim 8, wherein each masking hood feature is configured to operate as a miniature shade or awning.

13. The display apparatus of claim 8, wherein the transparent panel comprises glass.

14. The display apparatus of claim 8, wherein the transparent panel comprises an acrylic plastic.

15. A display apparatus, comprising:

a transparent panel, wherein the transparent panel includes a first portion and a second portion such that the first portion comprises a first cavity portion and the second portion comprises a second cavity portion that together define a single cavity within the interior of the transparent panel;

a display system for displaying information, the display system being enclosed in the single cavity within the transparent panel, wherein the display system comprises:

an array of light emitting diodes configured to display alphanumeric characters responsive to at least one control signal;

a controller configured to generate the at least one control signal, wherein the controller controls the array to provide a plurality of control modes to alter a manner for displaying the alphanumeric characters on the array, the plurality of control modes include a fixed mode for displaying the alphanumeric characters in a fixed position, a rotating mode for scrolling the alphanumeric characters in a horizontal direction, a waterfall mode for scrolling the alphanumeric characters in a vertical direction and an alternating mode for switching between a first display of alphanumeric characters and a second display of alphanumeric characters;

a fundamentally transparent molded substrate configured to support the array of light emitting diodes and the controller, configured to provide electrical interconnection between the light emitting diodes and the controller and configured to be positioned in the single cavity such that a back side of the fundamentally transparent molded substrate abuts an inside surface and inside side walls of the first cavity portion; about each light emitting diode, masking hood features extend from a front surface of the fundamentally transparent molded substrate to an inner surface of the second portion such that the fundamentally transparent molded substrate is held within the single cavity.

16. The display apparatus of claim 15, further comprises a user interface adapted to enable selection of one of the plurality of control modes and selection of the alphanumeric characters for display on the array.

17. The display apparatus of claim 15, wherein the masking hood features are configured to operate as a miniature shade or awning.

18. The display apparatus of claim 15, wherein the transparent panel comprises glass.

19. The display apparatus of claim 15, wherein the transparent panel comprises an acrylic plastic.

* * * * *